United States Patent [19]

Kaalstad

[11] Patent Number: 5,064,007

[45] Date of Patent: Nov. 12, 1991

[54] THREE DISC DRILL BIT

[75] Inventor: Oscar W. Kaalstad, Winter Springs, Fla.

[73] Assignee: Norvic S.A., Geneve, Switzerland

[21] Appl. No.: 540,161

[22] Filed: Jun. 19, 1990

Related U.S. Application Data

[63] Continuation of Ser. No. 275,726, Nov. 23, 1988, abandoned.

[51] Int. Cl.[5] ..... E21B 10/12

[52] U.S. Cl. ..... 175/334; 175/351; 175/355; 175/365; 175/367; 175/371; 175/376; 175/408

[58] Field of Search ..... 175/334, 336, 344, 351, 175/352, 354, 355, 365–367, 371–373, 376, 408

[56] References Cited

U.S. PATENT DOCUMENTS

| | | | |
|---|---|---|---|
| 334,594 | 1/1886 | Maloy | 175/351 |
| 1,131,701 | 3/1915 | Hughes | 175/351 |
| 1,388,497 | 8/1921 | Wadsworth | 175/371 |
| 1,812,475 | 6/1931 | Gildersleeve et al. | 175/367 |
| 1,843,096 | 1/1932 | Kubin et al. | 175/373 |
| 1,846,212 | 2/1932 | Kubin et al. | 175/351 |
| 2,174,102 | 9/1939 | Catland | 175/367 |
| 2,634,955 | 4/1953 | Johnson | 175/365 |
| 2,915,291 | 12/1959 | Gulfelt | 175/376 |
| 4,512,425 | 4/1985 | Brock | 175/408 |
| 4,751,972 | 6/1988 | Jones et al. | 175/336 |

*Primary Examiner*—Bruce M. Kisliuk

*Attorney, Agent, or Firm*—Julian C. Renfro

[57] ABSTRACT

A drill bit for use in drilling a well bore in accordance with this invention comprises a main drill body adapted to be rotated about a substantially vertically disposed axis of rotation and having therein a duct extending longitudinally along such axis, for supplying a drill fluid under pressure to the well bore. Three generally circular, rotatable cutting discs are mounted on the outside of the main drill body at equally spaced locations, with the cutting discs each having cutting elements disposed in a ring-shaped array. Each of the cutting discs has an axis of rotation disposed at an acute angle to the vertical centerline about which the main drill body rotates. Importantly, the axis of rotation of each cutting disc is slightly offset from the centerline of the main drill body, thus to cause the cutting discs to be positioned to be particularly effective and aggressive in cutting the well bore.

24 Claims, 4 Drawing Sheets

FIG 7
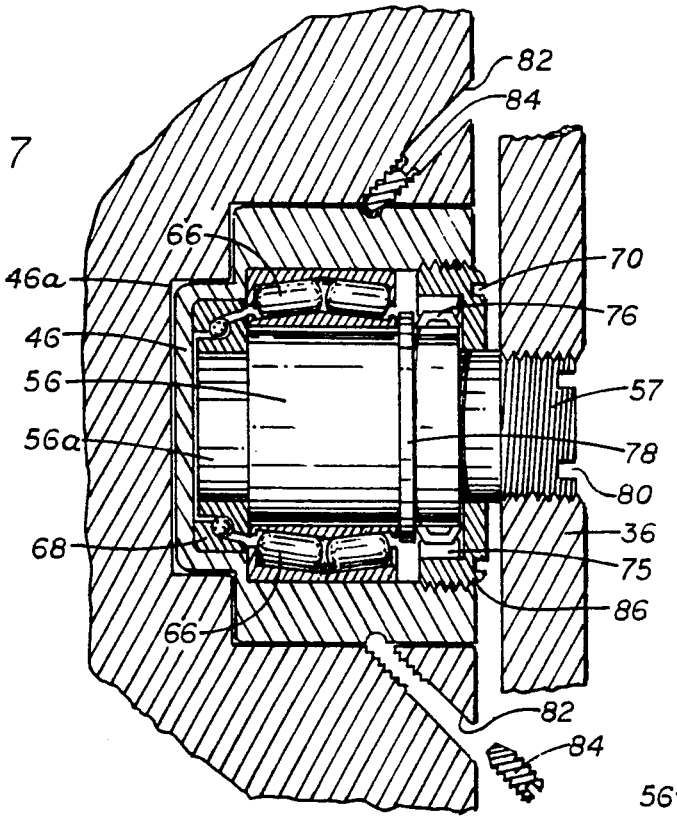
FIG 7a
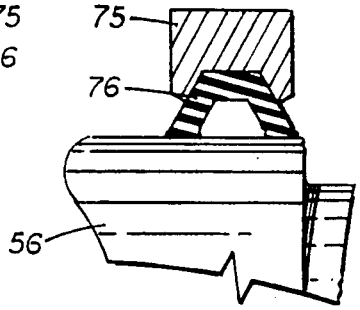
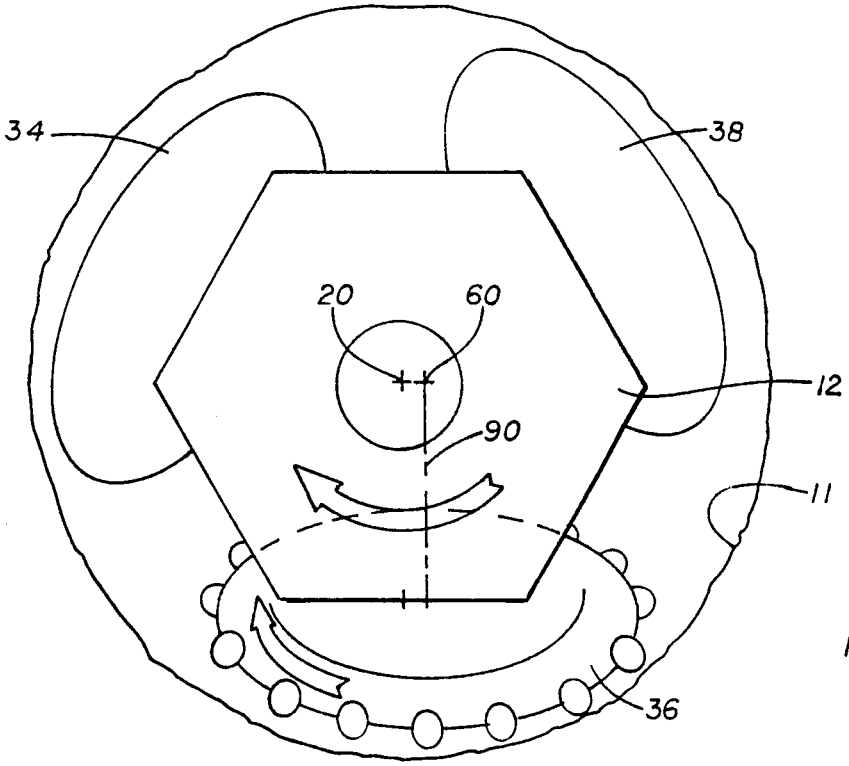
FIG 8

THREE DISC DRILL BIT

This is a continuation of application Ser. No. 275,726 filed Nov. 23, 1988, now abandoned.

The present invention concerns a drilling device comprising a drilling head equipped with a rotating body through which runs a duct for supplying drilling fluid or air to three rotating cutting discs symmetrically placed on the outside of the main body.

Existing drilling devices comprising a drilling head equipped with three cutting elements markedly conical or in the shape of a truncated cone have been known and used since the 30's. These devices require great pressure to break the rock and subsequently cut it up and flush it away. Because of the great compression needed to break the rock, such devices affect a greater surface than that of the drilling, thus creating an irregular drilling profile and an unstable wall.

Subsequently, development of a single disc device as described in the Kaalstad U.S. Pat. No. 4,549,614, entitled "Drilling Device," which issued Oct. 29, 1985, enabled the drilling of holes with more stable walls because of the application of the principle of shear instead of compression.

The present invention makes it possible to produce e a drilling device operating at low power, and reduced down pressure, utilizing three novel cutting elements mounted on the outside of the drilling head, enabling the device to break and evacuate rock more rapidly than with other known methods.

The present invention aims to make it possible to produce a drilling device operating at low power, utilizing three novel cutting elements easily mounted on the drilling head and enabling the evacuation of large pieces of debris.

SUMMARY OF THE INVENTION

The drilling device, according to the instant invention, is characterized by the fact that the cutting elements are discs provided with highly efficient cutting surfaces. Because the discs act at the bottom and on the wall to be cut by a ring-shaped surface equipped with cutting means, the action of the discs is to shear the bottom and wall material and not to compress it in order to obtain its disintegration. There is certainly a slight compression by the discs at the bottom of the hole, but it is not essential to the working of the device. The power and down pressure needed for drilling is relatively low, the drilling being achieved by shearing and not by compression, thereby obtaining a more stable wall.

Quite advantageously, by the use of this invention, faster straight line rock penetration by constant hole diameter can be readily accomplished by using less downward pressure and power and by lowering substantially the cost per foot drill.

This is accomplished in accordance with this invention by employing the principle of shear instead of percussion. Thus, by utilizing aggressive rotatable discs mounted on the housing member or main body, the drilling rate can be increased without increasing the downward pressure, thereby enabling the driller to use smaller rigs at lower cost.

As previously mentioned, my novel drilling head is equipped with three rotatable cutting discs placed at equal intervals along the rotating body, in a configuration that has inherent dynamic balance. In the preferred arrangement, the rotational axis of each rotating disc with respect to the body is displaced from the axis of rotation of the device so that the cutting discs are positioned to provide some offset to provide shearing action as the discs rotate.

The novel structure I utilize is particularly effective in removing rock with compression ratios below 20,000 psi. My novel drill is also effective above this hardness, but its advantage over conventional methods is gradually reduced at very hard rock.

My invention will, quite advantageously, drill in a straight line because the multiple symmetrically placed disc are utilized as stabilizers for each other, and provide a self-regulating, inherently dynamically balanced configuration that ensures straight line drilling.

My device is designed to provide an aggressive cutting disc by offsetting the axis of rotation of each disc by a small distance, such as 1/16th inch to ¼th inch from the horizontal centerline in the main body. This offset provides the aggressivity of the discs, and as each disc is offset equally, there is a resultant symmetry which provides directional stability to the drill bit, by each disc providing a counteracting function that results in straight line penetration.

The ducts through which water, drilling muds, or air pass out of the main body are designed to provide adequate flow to flush out the broken rock and the smaller ducts behind the discs and the main body, and to cool the wheels during drilling, while providing bailing action to clear cuttings from the bore hole.

My drill bit utilizes a novel, hexagonally shaped upper portion, which I may call a gauge ring, at the top of the main portion of the drill bit. A drilling bit is utilized at each of the six outer points of the gauge ring, so even at extended drilling, my invention will insure a constant diameter of the hole. This is so in spite of the possibility that the teeth of the cutting discs will wear, thus reducing the actual diameter of the discs, and in turn reducing the diameter of the hole being created in the rock. Such wear would, under ordinary circumstances, result in several millimeters of hole diameter shrinkage during severe conditions of operation, but in the case of my novel drill, this is effectively compensated for by the effective action of the hexagonally shaped gauge ring during the rotation of the main body of my three disc drill bit.

I prefer for the hexagonally shaped gauge ring to be equipped with highly wear resistant inserts at each hexagon point, and it is these maximum diameter points that touch the wall at the specified distance from the center of the hole. Therefore, if the discs would wear after extensive drilling, the novel gauge ring insures constant diameter of the hole, by removing the residual rock not reached by the worn cutting surface of the discs. Theoretically, the inserts of the gauge ring will eventually be subject to wear as well, but in practice this system insures hole diameter stability in most drilling applications beyond the distance at which other conventional systems would already have failed.

The same general principle applies to the bottom central portion of the main body or housing member, where I provide a cutting surface to remove residual "chimneys" of rock that may result from non-breakage of the rock not directly reached by the cutting surfaces of the discs. A simple high-wear cutting surface known as a "pip breaker" will remove these "chimneys" faster than the disc s can penetrate the hole, so that penetration rate is not dependent upon the center part nor upon the hexagonal points, both of which are reinforced to remove residual rock, while the three rotating discs remain the main cutting elements.

My drill design advantageously facilitates individual or multiple replacement of the discs without replacing the whole drill bit, as each disc, spindle and bearings are provided in a pre-assembled, sealed cartridge system, which I may refer to as spindle housing. These are quite easy to replace, should this be necessary.

As should now be clear, my invention provides a self-aligning drill bit very well suited to drilling exceedingly straight, constant diameter holes, using lighter and less costly equipment, at penetration rates 20–400 percent faster than conventional methods. My drill device has been engineered to withstand easily all shocks, pressures, and wear normally encountered in commercial drilling operations.

It is therefore to be seen that a drill bit for use in drilling a well bore in accordance with this invention comprises a main body adapted to be rotated about a substantially vertically disposed axis of rotation and having therein a duct extending longitudinally along the axis for supplying a drill fluid or air under pressure to the well bore.

Three rotatable cutting discs are mounted on the outside of the main body at equally spaced locations, with these cutting discs having multiple cutting elements. Each of the cutting discs has an axis of rotation disposed at an acute angle to the vertical axis about which the main body rotates, and with the axis of rotation of each cutting element being displaced from the axis of rotation of the main body, thus to cause the cutting elements to be positioned to cause aggressive cutting in the direction of rotation of the main body.

The angle at which the axes of rotation of the cutting discs are disposed is typically between 20 and 40 degrees below the horizontal, which of course would be 50 to 70 degrees to the axis of rotation of the main body.

It is therefore a principal object of my invention to provide a drill bit for drilling a well bore that is of inexpensive and highly effective construction, which drill bit is further characterized by being self-aligning, and thus having the ability to drill an exceedingly straight well bore.

It is another object of my invention to provide a drill bit highly effective for drilling a well bore, utilizing three rotatable cutting discs mounted on the outside of the main body, having axes of rotation disposed at an angle to the vertical axis about which the main body of the drill bit rotates, with these axes of rotation also being slightly displaced from the axis of rotation of the main body so as to bring about a particularly effective cutting action.

It is still another object of my invention to provide a multi-disc drill bit whose rate of penetration through various rock hardnesses can be kept constant merely by varying rotational speed, with downward pressure being able to be kept at the same comparatively low level. In this way the user is able to utilize lighter, lower cost equipment, with lower operating costs, while still being able to obtain high rock penetration rates.

It is yet still another object of my invention to provide a drill bit utilizing three rotatable discs, each supported from its individual spindle unit, with each spindle unit being readily replaceable whenever necessary, thus minimizing the amount of downtime of the drill bit.

These and other objects, features and advantages will become more apparent as the description proceeds.

BRIEF DESCRIPTION OF DRAWINGS

FIG. 7 is a cross-sectional view taken through a typical spindle housing or bearing housing in order that internal construction will be revealed;

FIG. *7a* is a fragmentary showing to a large scale of the seal construction I prefer to use; and FIG. 8 is a view of the main drill body, taken looking downwardly at the location indicated at 8——8 in FIG. 1, so as to reveal the typical offset in accordance with this invention of the axis of rotation of a cutting disc.

DETAILED DESCRIPTION

Figure 1:
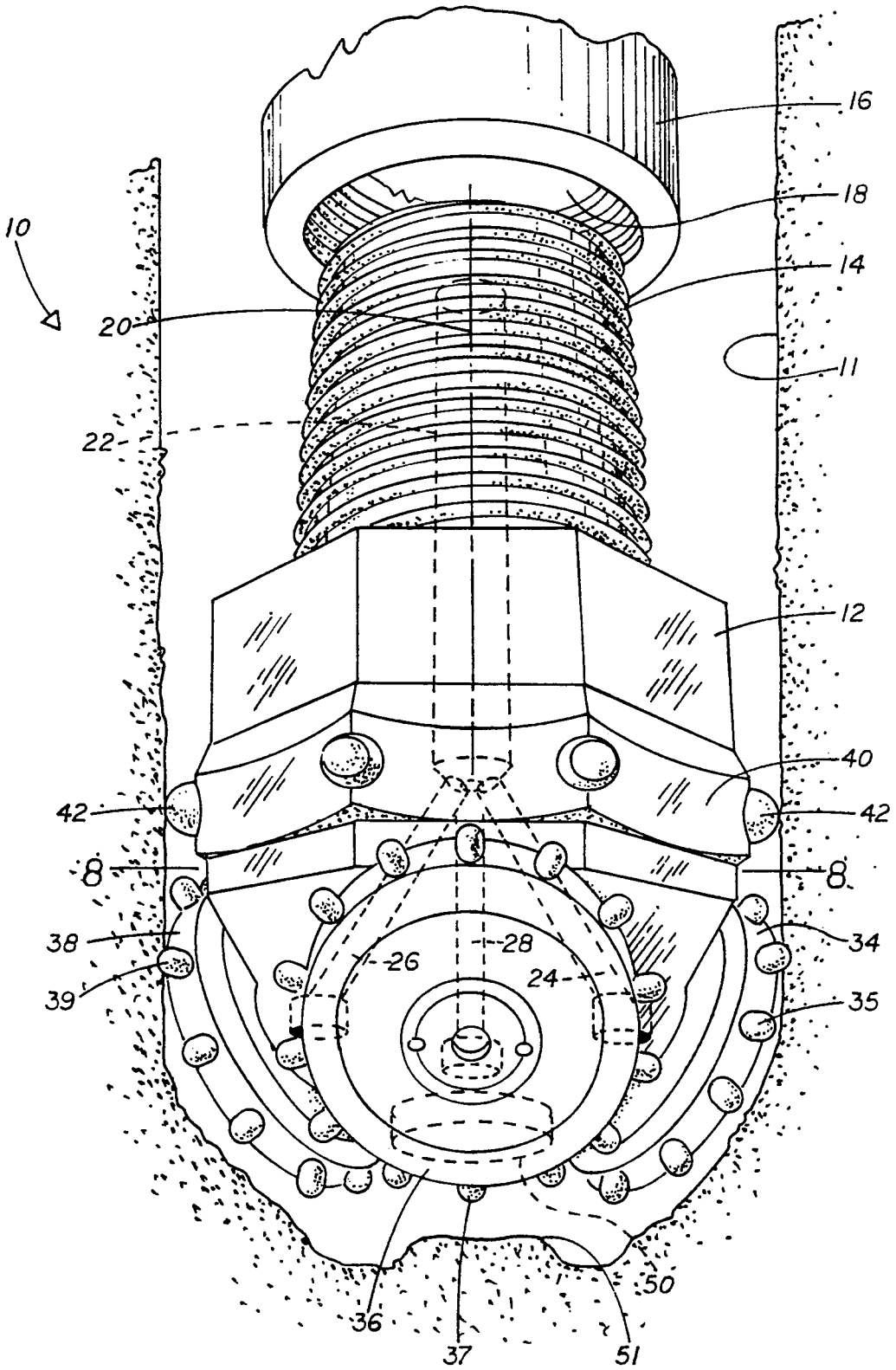
FIG. 1 is a perspective view of my novel three disc drill bit, in this instance illustrated residing near the bottom of a hole that has been drilled into rock, with the rotary drive shaft utilized for driving the drill bit in rotation being shown slightly separated therefrom.

With initial reference to FIG. 1, a novel rotary drilling device 10 in accordance with my invention may be seen to comprise a body member or housing 12 fitted with standard male thread connector 14 at its uppermost portion, enabling it to be connected to a rotary drive system, in this instance a rotary drive shaft 16 equipped with female threads at its lowermost end. By engagement of the male and female threads, the body member or housing 12 is enabled to be attached very tightly to the lowermost end of the drive shaft 16, yet readily removed therefrom for replacement should such become necessary from time to time.

The power-applying shaft 16 has a centrally disposed longitudinal hole 18 to permit the flow of coolant therethrough, and the shaft is rotatable about a centerline or axis of rotation 20. The centerline may be regarded as also extending through the body member 12, with the rotative components on the body member having a symmetrical relationship to the centerline or axis of rotation 20.

The body member 12 has a centrally located coolant duct 22 located in alignment with the central hole 18, with duct 22 opening into three orifices 24, 26 and 28 provided for the circulation of drilling fluid or air under pressure to the area of the rotating discs or wheels 34, 36 and 38 mounted on the body member 12, which discs or wheels represent a principal part of my invention. It is to be realized that the duct 22 and the orifices 24, 26 and 28 have not been shown to true scale, in the interests of clarity. As will be noted in FIG. 1, the discs 34, 36 and 38 serve to create a generally circular hole 11 in the rock being penetrated.

Also visible in FIG. 1 is a gauge ring 40, that is preferably six sided. It is to be realized that any two opposite sides of the upper portion of the main body 12 may serve as wrenching flats, as will enable the main body to be tightened to or loosened from, the rotary drive shaft 16. In accordance with this invention, I mount a cutting insert or tooth 42 at the intersection of each of the six sides of the gauge ring, which may be regarded as the maximum diameter portion of the drill bit.

It will be noted with regard to the six-sided gauge ring that each of the sides extends a bit inwardly from a straight-across configuration, with this construction being utilized to provide additional space for pieces of rock and other cuttings to pass through and be removed from the disc area under the influence of the fluid used during operation of the drill bit. This detail is made quite clear in FIG. 5. I may refer to the gauge ring 40 as being in the shape of a modified hexagon.

During extended drilling, the construction I prefer will insure a constant diameter of the hole being created in the rock, in spite of the possibility that the cutting surface of the discs should wear, and thereby reduce the effective diameter of the wheels or discs 34, 36 and 38. The reduction of disc diameter would, of course, result in the reduction of the diameter of the hole 11 being created in the rock. The reduction in diameter otherwise taking place is compensated for in accordance with this invention by the inserts 42 of the hexagonal gauge ring 40 utilized at the maximum diameter, upper portion of the drill bit. These are of course highly wear resistant inserts located at each hexagon point that touches the hole 11 created in the rock, as previously mentioned. Theoretically, the inserts or teeth 42 of the gauge ring 40 would eventually be subject to wear as well, but in practice my novel system will insure a hole diameter stability in most drilling applications beyond the distance at which other conventional systems would already have failed, by removing the residual rock not reached by the worn teeth of the wheels or discs.

The hexagonal configuration I use has the further advantage mentioned above, of providing space between the well bore and the flats of the member 40, through which cuttings are flushed out, with each of the six sides extending a bit inwardly in order to maximize the space through which the cuttings may pass.

Figure 2:
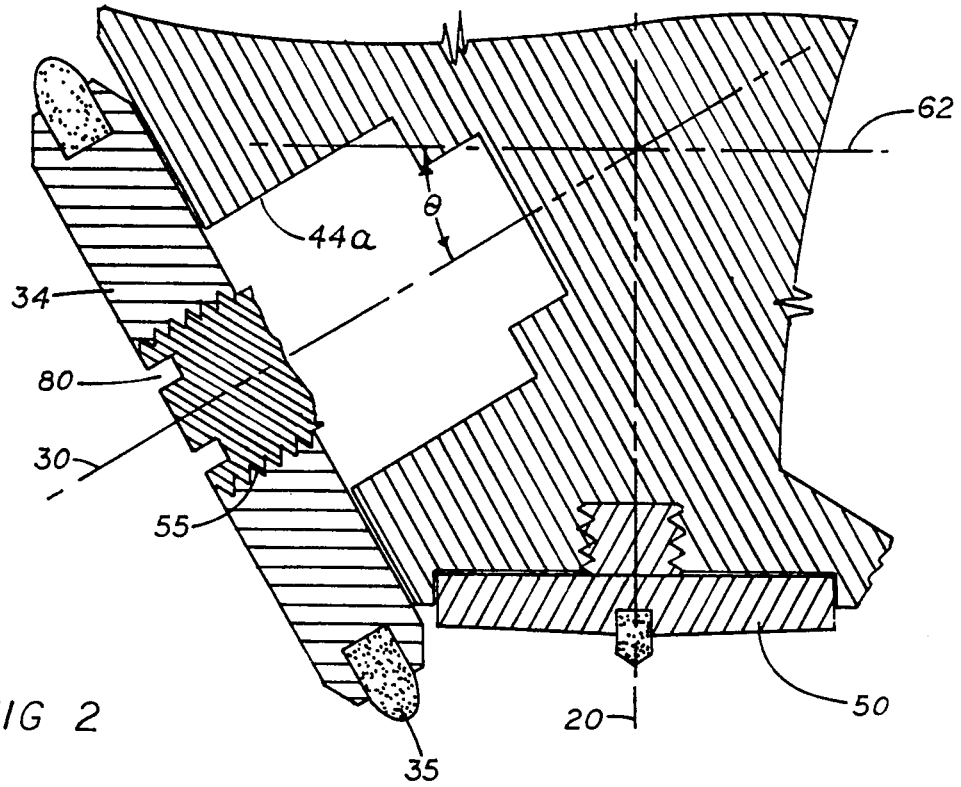
FIG. 2 is a cross-sectional view illustrating an angle below the horizontal plane at which the axis of rotation of a given cutting disc is typically located.
Figure 3:
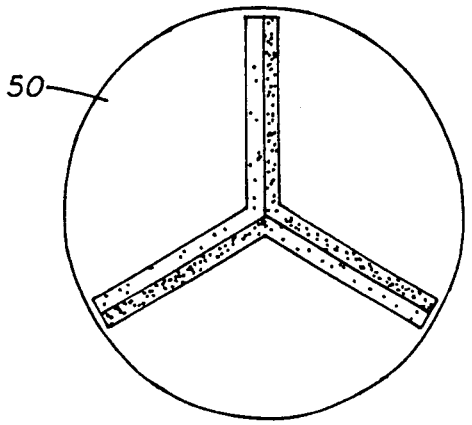
FIG. 3 is a view of a typical cutting member known as a "pip breaker"

The same general principle applies to the bottom center part of the main body, where a cutting surface 50 has been inserted at the central bottom portion of the body 12 to remove residual "chimneys" 51 of rock that may result from non-breakage of the rock not directly reached by the cutting surface of the discs 34, 36 and 38; note FIGS. 2 and 3. I have found that a simple, highly wear-resistant cutting surface 50 will remove these "chimneys" 51 faster than the discs can penetrate the hole, so that penetration rate is not dependent upon the center part nor upon the hexagonal points, both of which are reinforced to remove residual rock, while the discs remain the main cutting element.

Figure 5:
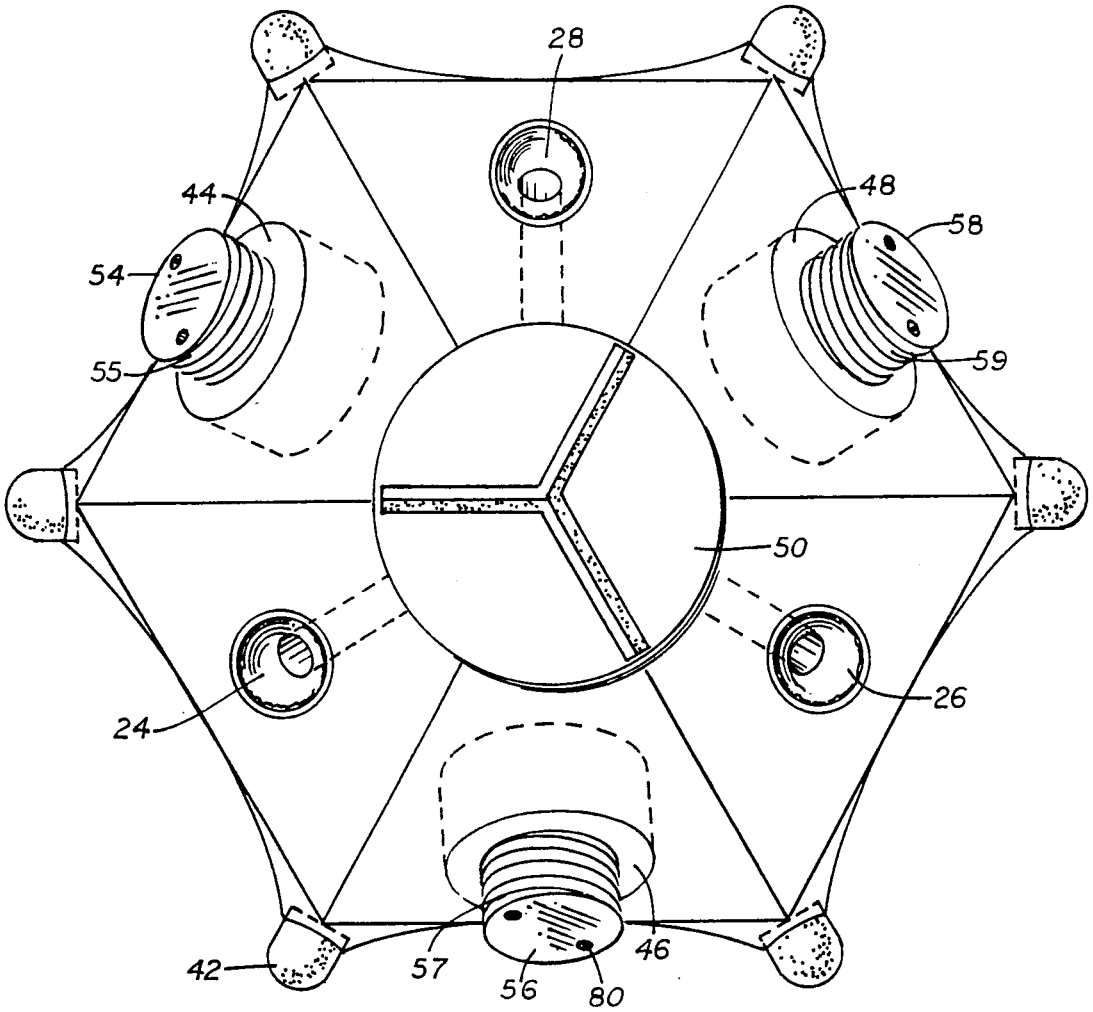
FIG. 5 is a view to a large scale taken directly below a typical drilling bit in accordance with this invention, with the rotary discs or wheels removed in order that the passages utilized for carrying coolant to the drilling area will be visible.
Figure 6:
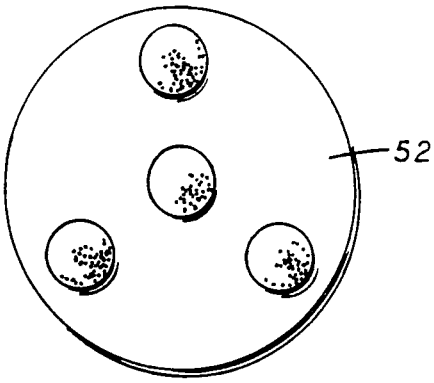
FIG. 6 is a view of a cutting member or "pip breaker" that is, different than the previous such member.

I am not to be limited to the configuration of the cutting surface or "pip breaker" 50 depicted in FIGS. 3 and 5, wherein the three straight cutting elements converge at the midpoint of the disc, for as depicted in FIG. 6, it is within the spirit of this invention to utilize a "pip breaker" 52 wherein hemispherical cutting elements are utilized. The cutting element 52 is preferably utilized when rock of great hardness is being encountered.

In FIG. 2, it will be noted that the lower portion of a housing or main body 12 has been cut through to reveal that the cutting element 50 (or 52) may be secured in place on the centerline 20 of the main body 12 by the use of a screw threaded arrangement. It is of course about the centerline 20 that the drill bit is caused to rotate by the efforts of the rotary drive shaft 16.

Also visible in FIG. 2 is the cavity 44*a* created in the main body or housing 12 to receive the spindle housing 44, which may also be known as the bearing housing 44. For convenience in this instance, the spindle housing 44 is not shown in place.

It is important to note in FIG. 2 that I have shown an axis of rotation 30, about which the disc 34 rotates. This axis of rotation is disposed at an angle $\theta$ with respect to the horizontal plane 62. All three discs rotate about axes that bear an identical angle to the horizontal plane, and this angle may vary between 15° and 45° to the horizontal. In the instance in which a drill bit having a commonly used diameter of $7\frac{7}{8}$ inches is utilized, the angle $\theta$ is approximately 30°, for I have found that this provides the best results over a range of varying conditions.

If the drill bit is 12 inches or larger in diameter, the angle $\theta$ would typically be increased to 35° to 40°, whereas if the drill bit is smaller than 6 inches in diameter, an angle $\theta$ of 15° to 25° will provide the best results.

As best seen in FIG. 5, I provide three spindle housings 44, 46 and 48 disposed in symmetrical relationship around the lower portion of the body 12, in each of which is a rotatable spindle, these being spindles 54, 56 and 58. The outer ends of spindles 54, 56 and 58 are provided with threads 55, 57 and 59, respectively, to receive the discs 34, 36 and 38.

It is important to note that all three bearing housings are deliberately offset slightly, in a clockwise sense as viewed in FIG. 8. In FIG. 8, the centerline of the main housing 12 is indicated at 20, whereas point 60 indicates an offset or displacement of between 1/16th inch and $\frac{1}{4}$th inch with respect to that centerline. It is to be understood that the axis of rotation of the disc 36 as well as its spindle 56 is disposed on the axis of rotation 90 that passes through the offset point 60.

It is to be realized that the offset axis 90 of the disc 36 does not amount to construction that is unique to disc 36, for the axes of rotation of discs 34 and 38 are likewise slightly offset to the same extent and direction from the centerline 20. In other words, the three discs are symmetrically mounted on the main housing 12, with the displacement or angular offset relation the axis of rotation each disc bears to the axis of rotation of the main housing about the centerline 20 being identical.

In FIG. 1, with its axis of rotation forming an acute angle with the axis of rotation 20 of the body 12, the face of each disc 34, 36 or 38 is oriented toward the concave bottom of the well bore or hole 11. As should now be clear, these discs are attached symmetrically around the axis of the rotation of the body, with the axis of rotation of each disc being at the same angle below the horizontal plane, and with the axis of rotation of each disc having an identical amount of offset from the centerline 20 of the main housing. This arrangement is inherently dynamically balanced, and self-aligning, as will readily enable an exceedingly straight hole to be drilled.

Because the cutting discs 34, 36 and 38 are positioned to provide some offset in the direction of rotation over a concentric arrangement, this displacement insures that cutting is performed by an appropriate cutting surface on each disc, with a suitable clearance existing between the trailing surface of the disc and the hole. This effectively prevents the stalling of the discs in rotation, which might be caused by engagement of the trailing surface with the hole if such offset was not provided.

This also facilitates removal of debris from the space thus created behind each disc. With this arrangement, cutting is advantageously performed by the surface in the lower leading or cutting quadrant of each disc.

The details of a typical spindle, bearings, and disc mounting are to be seen in FIG. 7. In this instance I have chosen to show the spindle housing 46 in which the spindle 56 is operatively mounted, with this view also revealing a fragmentary portion of disc 36 supported upon the threads 57 of the spindle 56. Inasmuch as all three spindles and all three wheels or discs are substantially identical, it is necessary to discuss in detail only one of each of these components.

Earlier I had mentioned in connection with FIG. 2 that a suitable aperture or cavity is made at three evenly-spaced locations on the main body, which holes or cavities angle somewhat downwardly, and possess a degree of offset, with the downward angle and the offset of each cavity being identical.

In FIG. 7, I show a typical aperture 46*a* for receiving a spindle housing, but in the interests of clarity, I have shown this aperture in a non-angled relationship, with a spindle housing cartridge 46 inserted tightly into this aperture.

Tapped holes are provided at the innermost end of at least two slots 82 that are drilled or otherwise formed at appropriately spaced locations in the main body 12, into each of which tapped holes a retaining screw 84 in the nature of a set screw is tightly inserted. These retaining screws 84 prevent undesired rotation of the spindle housing 46 with respect to the main body 12.

The innermost end of the spindle housing 46 is of somewhat reduced diameter, and into this location, a ball bearing 68 is tightly inserted. The design of ball bearing 68 is such as to accept both thrust and radial loading. It is in bearing 68 that the innermost end 56*a* of the spindle 56 is received and supported. By having the innermost end of the spindle of reduced diameter, a shoulder is thereby provided on the spindle shaft, which serves to hold the inner race of the bearing 68 in a proper operative relationship.

The outer end of the spindle 56 is threaded at 57 in a direction so as to minimize the likelihood of the disc 36 being lost off the end of the spindle during its rotation. Spanner wrench holes 80 are provided in the end of each spindle, so the spindle can be held against rotation as the respective disc is being tightened into place.

The principal support for the rotatable spindle 56 is provided by a double spherical roller bearing 66, with this bearing residing in the correct position not only by its contact with the large diameter rear portion of the bearing housing 46, but also by retaining collar 78, which serves to prevent undesired motion of the spherical roller bearing 66 in the opposite direction. The retaining collar 78 is an intrinsic portion of the spindle 56. Both the inner race and the outer race of the bearing 66 are tightly fitted into their respective operative locations, to prevent undesired relative motion.

On the opposite side of the retaining collar 78 from the double row bearing 66 is a heavy duty two way seal 76, preferably made of buna rubber or similar material, such as another suitable elastomer. The outermost portion of the seal 76 is captive in an encircling ring 75 of steel or the like; note FIG. 7*a*.

The seal 76 is kept in the desired relationship to the retaining collar by a lock ring 86, which is threadedly received in the outermost portion of the spindle housing 46, and equipped with a pair of spanner wrench holes 70.

The interior of locking ring 86 may be seen in FIG. 7 to contain the heavy duty double seal 76, and this construction serves to keep lubricant in, and foreign materials out. The arrangement is such that when the locking ring 86 exerts pressure against the seal 76, the sealing action increases. When the spindle housing or cartridge is packed with lubricant, and the locking ring 86 has been tightened, the entire assembly is under high pressure, and the seal 76 quite effectively prevents any ambient fluid or abrasives from penetrating the seal that is formed adjacent the end of the spindle.

This is advantageous in drill bits where protection of the bearings is of paramount importance to insure trouble-free operation.

As to the operation of my novel three disc drill bit, when the discs are placed so that the axes through which they revolve intercept the axis of the main body at an angle, each disc would normally rest against the bottom and sides of the hole having direct contact between the cutting surface and the surface of the hole over an extended length. (Example 90° or ¼ of disc circumference.)

As was described in conjunction with FIG. 8, the axis of rotation of each disc does not pass through the center axis 20 of the main body 12, so each disc is caused to rest upon the bottom of the hole 11 at one point. The downward pressure applied from the surface is concentrated upon this one point, thereby insuring maximum rock penetration at this point, with minimum downward pressure. In contrast with this, a tri-cone drill bit would have been resting upon 20–45 cutting element points and would have required greater pressure for maximum rock penetration. Thus it is to be seen that my invention assures maximum rock penetration rates under conditions of low pressure, high speed of rotation, or combinations of both.

The removal of the rock is caused by the cutting elements penetrating the rock because of pressure, and removing the rock by shear action resulting from the three discs turning in a counter-clockwise direction, as a direct result of the clockwise rotation of the drill pipe. Although disc 36 is shown in FIG. 8 to be turning in a clockwise direction, it would be turning in a counter-clockwise direction as viewed from its outer face.

Because the axes of the discs are offset from the centerline 20, the penetration of the rock is facilitated through a large increase in pressure at the cutting point of each disc. If the respective axes of the discs were not offset from the axis of rotation of the main body, the downward pressure would be distributed on the cutting elements of the discs where they are in contact with the bottom and the sides of the hole. Therefore, by displacing the axes of the discs to the rear of the axis of rotation of the main drill body, all the pressure is advantageously concentrated on one or a few cutting points. Therefore, even at modest downward pressure from the drill rig located on the surface, which may be 2 to 3 tons per square inch, concentrating this pressure onto one or a few cutting points increases many fold the available pressure at the cutting point of each disc, thus insuring the highly effective penetration of rock.

Figure 4:
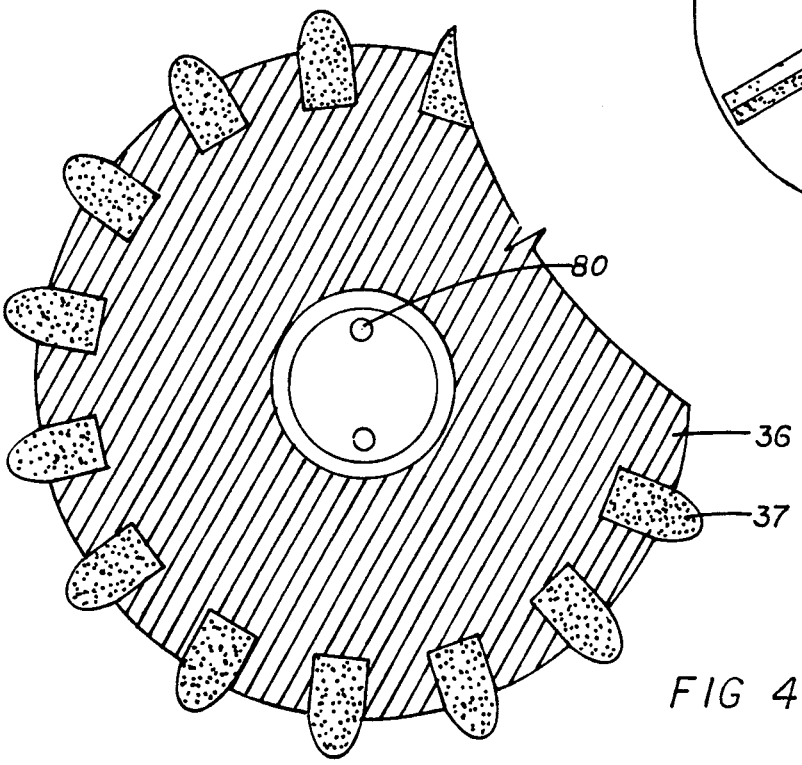
FIG. 4 is a face-on view of a typical cutting disc, with a portion of the disc in this instance removed so as not to collide with the adjacent figure.

With reference now to a conventional clock face, by having offset to the rear the axes of rotation of the three discs with respect to the vertical centerline of the main drill body, as was depicted in FIG. 8, the cutting elements, as viewed in FIG. 4, begin to cut at approximately 7 o'clock, cut deepest at approximately 6 o'clock, and move out of contact with the sidewalls of the hole at 3 o'clock. In this context, the 3 o'clock position of the disc may be regarded as the trailing surface.

The rear offset utilized in accordance with this invention is to prevent possible "jamming" in front of the lead cutting elements, and also to insure that the rock removal flows in the same direction as the flow of the flushing media (air, drilling mud) flowing through passages or orifices 24, 26 and 28.

The cutting elements such as displayed in FIGS. 2 and 4 can have highly wear-resistant teeth or inserts. Disc 34 in FIG. 2 has a plurality of teeth or inserts 35, and disc 36 has a plurality of teeth or inserts 37, and these may be of steel that has been coated with wear-resistant materials, such as Tungsten Carbide, Titanium Nitrite, etc. Alternatively, the teeth or inserts may be made from wear resistant material such as Tungsten Carbide or irregular shaped Diamond, Tungsten Carbide, and similar cutting materials embedded in a metal alloy matrix specifically designed to hold such materials while providing a large total cutting surface. It is thus to be seen that the teeth or inserts are disposed in a ring-shaped array, and positioned to be effective in cutting rock over a wide range of angles of the axes of the three discs, with respect to the axis of rotation 20 of the main body 12, and of course to the horizon.

The cutting teeth are secured in the respective discs by "state of the art" welding techniques, as is the placement of similar cutting elements in irregular form in the matrix around the disc.

Because by the use of my novel three disc drill bit the sidewall of the hole is less likely to give way than when using a conventional drilling head, the cost of installing tubers to prevent the wall from collapsing can be significantly reduced. Inasmuch as each of the cutting discs I use rest only on part of the hole bottom, less than half, it leaves ample space for the evacuation of large pieces of excavated rock.

Because of the many significant features of the present device, the drilling head can be removed for repairs or sharpening without having to remove the tubing which would cause the wall to collapse and the partial reblocking of the hole. This device also enables the cutting disc to be changed if, at a certain depth, the type of ground changes, going, for instance, from a layer of sand to a much harder layer. In this way, time is saved.

Since the head may often be used to enlarge the diameter of a previously drilled hole, the dimensions of a cutting disc and/or the length of its rotating shaft are greater than those of the preceding disc and smaller than those of the following disc, going from the lower end to the upper end of the rotating body. Finally, in the case of enlargement of the diameter of the hole, the lower drilling device which serves only as a guide can be a conventional drill bit. The cutting surface of each disc can be approximately the shape of a truncated cone or a spherical ring.

It should now be clear that my cutting discs are each attached to a respective assemblage of rotors, roller bearings and thrust bearings in cartridge form, that is, each cutting disc is associated with a respective spindle housing that is to be inserted into a suitable cavity located in the main body 12, where each of the spindle housings is effectively locked.

Because these spindle housings or bearing housings are installed as separate units in the main body, the spindle housings can be individually removed and replaced without disturbing any other component of the rotary drilling device, thus greatly diminishing down time.

By enabling the operator to replace wear affected parts separately, the overall operating cost of a drilling bit will be reduced by as much as 30%. By separating the manufacture of the drilling disc, spindle, and cartridge unit from the main body of the bit, it will enable said cartridge to be made to precision tolerances, resulting in substantially improved performance.

Because the three disc configuration I use involves the discs counter-reacting to each other to offset cutting pressure, and because the configuration involves an inherently dynamically balanced arrangement, I can drill much straighter holes than were previously possible.

I claim:

1. A drill bit for use in drilling a well bore, comprising a main drill body adapted to be rotated about a substantially vertically disposed axis of rotation and having therein a duct extending longitudinally along said axis for supplying a drill fluid under pressure to the well bore, three generally circular, rotatable cutting discs mounted on the outside of said main drill body at equally spaced locations, said cutting discs each having cutting elements disposed in a ring-shaped array, each of said cutting discs having an axis of rotation disposed at an acute angle to the vertically disposed axis about which said main drill body rotates, and with the axis of rotation of each cutting disc being slightly offset laterally in a rearward direction from the vertically disposed axis of the main drill body, in relation to the direction of rotation of said main drill body, thus to cause said cutting discs to be positioned to be particularly effective in the well bore.

an upper portion of said main drill body being of polygonal configuration having a plurality of cutting means thereon, said cutting means being disposed in a spaced array around a maximum diameter location of said polygonal configuration of said main drill body, the use of said cutting means at said maximum diameter location on said main drill body assuring a desired size of well bore diameter, despite some wear of the cutting discs with use.

2. The drill bit as defined in claim 1 in which the acute angle said axes of rotation of said cutting discs bear to the main drill body is an angle displaced 70 degrees to 50 degrees from said vertically disposed axis of rotation of said main drill body.

3. The drill bit as defined in claim 1 in which the amount of offset of the axis of rotation of each disc from the centerline of said main drill body is approximately 1/16th inch to ¼th inch.

4. The drill bit as defined in claim 1 in which said rotatable cutting discs are dynamically balanced, and the drill bit is self-aligning.

5. The drill bit as defined in claim 1 in which a cutting disc is mounted on the vertical centerline, at the lowest point of said main drill body, to rotate at the speed of rotation of said main body, to remove any rock formation left by the rotatable cutting discs.

6. The drill bit as defined in claim 1 in which said cutting discs are substantially flat discs.

7. A drill bit for use in drilling a well bore, comprising a main drill body adapted to be rotated about a substantially vertically disposed axis of rotation and having an upper portion as well as a duct extending longitudinally along said axis for supplying a drill fluid under pressure to the well bore, three generally circular, rotatable cutting discs mounted on the outside of said main drill body at equally spaced locations, said cutting discs each having cutting elements disposed in a ring-shaped array, each of said cutting discs having an axis of rotation disposed at an acute angle to the vertically disposed axis about which said main drill body rotates, and with the axis of rotation of each cutting disc being slightly offset from the centerline of said main drill body, thus to cause said cutting discs to be positioned to be particularly effective in the well bore, the upper portion of said main drill body having a plurality of cutting means thereon, said cutting means being disposed in a spaced array around a maximum diameter location of said main drill body, the use of said cutting means at said maximum diameter location on said main drill body assuring a desired size of well bore diameter, despite some wear of the cutting discs with use, said upper portion of said main drill body being of polygonal configuration, with said plurality of cutting means being utilized in outwardly protruding locations on said main drill body.

8. The drill bit as defined in claim 7 in which said main drill body is of hexagonal configuration, with six cutting means used thereon.

9. A drill bit for use in drilling a well bore, comprising:

a main drill body adapted to be rotated about a substantially vertically disposed axis of rotation and having an upper portion as well as a duct extending longitudinally along said axis for supplying a drill fluid under pressure to the well bore, three generally circular, rotatable cutting discs mounted on the outside of said main drill body at equally spaced locations, said cutting discs each having cutting elements disposed in a ring-shaped array, each of said cutting discs having an axis of rotation disposed at an acute angle to the vertically disposed axis about which said main drill body rotates, and with the axis of rotation of each cutting disc being slightly offset from the centerline of said main drill body, thus to cause said cutting discs to be positioned to be particularly effective in the well bore, the upper portion of said main drill body being of polygonal configuration, having a number of sides of equal size, with a cutting insert located at the intersection of each pair of adjacent sides, such cutting inserts being located at the maximum diameter portion of said drill bit, the use of said cutting inserts in maximum diameter locations on said main drill body, assuring a desired size of well bore diameter, despite some wear of the cutting discs with use.

10. The drill bit as defined in claim 9 in which the acute angle said axes of rotation of said cutting discs bear to the main drill body is an angle between 20 and 40 degrees from the horizon, which axes are therefore displaced 70 degrees to 50 degrees from said vertically disposed axis of rotation of said main drill body.

11. The drill bit as defined in claim 9 in which the amount of offset of the axis of rotation of each disc from the centerline of said main drill body is approximately 1/16th inch to ¼th inch.

12. The drill bit as defined in claim 9 in which said rotatable cutting discs are dynamically balanced, and the drill bit is self-aligning.

13. The drill bit as defined in claim 9 in which a cutting disc is mounted on the vertical centerline, at the lowest point of said main drill body, to rotate at the speed of rotation of said main body, to remove any rock formation left by the rotatable cutting discs.

14. The drill bit as defined in claim 9 in which said cutting discs are substantially flat discs.

15. The drill bit as defined in claim 9 in which said upper portion of said main drill body is of hexagonal configuration, with six individual cutting inserts used thereon, thus assuring a certain desired well bore diameter.

16. A drill bit for use in drilling a well bore, comprising a main drill body adapted to be rotated about a substantially vertically disposed axis of rotation under substantial drilling pressure, said main drill body having therein a duct extending longitudinally along said axis for supplying a drill fluid under pressure to the well bore, three generally circular, rotatable cutting discs mounted on the outside of said main drill body at equally spaced locations, said cutting discs each having cutting elements in the form of cutting points disposed in a ring-shaped array, each of said cutting discs having an axis of rotation disposed at an acute angle to the vertically disposed axis about which said main drill body rotates, and with the axis of rotation of each cutting disc being slightly offset from the centerline of said main drill body, thus to cause said cutting discs to be positioned to be particularly effective in the well bore, to cause the drilling pressure to be concentrated on only a few cutting points, and to insure chip removal in the direction of flow of the drill fluid, the upper portion of said main drill body being of polygonal configuration, with a plurality of fixed cutting elements used thereon, said cutting elements being attached in maximum diameter locations on said main drill body, so that said cutting elements can cut a well bore of a size corresponding to that created by said cutting discs, with such well bore diameter being assured, despite some wear of the cutting discs with use.

17. The rotary drilling device as recited in claim 16 in which each of said rotatable cutting discs is supported from a respective spindle housing, with said spindle housings being separately removable as a unit from said drill body, to make rapid replacement possible, with minimum downtime.

18. The rotary drilling device as recited in claim 16 in which the angle said axes of rotation of said rotary cutting members bear to a horizontal plane passing through said drill body is an angle between 20 and 40 degrees below such horizontal plane.

19. The rotary drilling device as recited in claim 16 in which the amount of offset of the axis of rotation of each rotary cutting member from the centerline of said main drill body is approximately 1/16th in inch to ¼th inch.

20. The rotary drilling device as recited in claim 16 in which said rotary cutting members are placed so as to effectively counter-react to each other, and are dynamically balanced, with said drilling device therefore being self-aligning.

21. The rotary drilling device as recited in claim 16 in which a rotary cutting member is mounted on the vertical centerline, at the lowest point of said main drill body, to rotate at the speed of rotation of said main body and to remove any rock formation left by the rotatable cutting members.

22. The rotary drilling device as recited in claim 16 in which said upper portion of said main drill body is of hexagonal configuration, with six fixed cutting elements used thereon, to assure a desired well bore diameter.

23. Rotary drilling device comprising a drill body fitted with means for connection to a rotary drive system, said drill body being traversed in the vertical direction by a centrally disposed conduit opening into orifices provided for the circulation of a drilling fluid under pressure for chip removal, said drill body having mounted thereon three rotary cutting members, said rotary cutting members being attached at symmetrically placed locations around the axis of rotation of said drill body, said rotary cutting members each being in the shape of annular discs and each having an outer face, the axis of rotation of each of which is slightly offset from the axis of rotation of said drill body, the outer faces of said cutting members being oriented somewhat downwardly from a horizontal plane passing through said drill body, each of said cutting members being supported by a respective spindle housing affixed inside a lower part of said drill body, the upper portion of said main drill body being of hexagonal configuration, with six cutting elements used thereon, said six cutting elements being used in maximum diameter locations on said main drill body, so that said cutting elements can cut a well bore of a size corresponding to that created by said rotary cutting members, with such well bore diameter thus being assured, despite some wear of the rotary cutting members with use.

24. A rotary drill bit for use in drilling a well bore involving three rotary cutting discs mounted at equal intervals on a lower portion of the rotatable main body of the drill bit, each of said cutting discs being supported from a respective cartridge comprising a rotatable spindle mounted in anti-friction bearings in an integrated sealed and lubricated unit, each of said cartridges being able to be locked into a respective, symmetrically placed cavity in said main body, means for removably attaching a cutting disc to the outer end of each of said spindles, which cutting discs represent the active drilling portions of said drill bit, each of said cartridges being able to be removed when necessary and readily replaced with one of like construction, whereby said drill bit is able to be quickly restored to operating condition without the necessity of a complete re-building operation, the upper portion of said main body being of hexagonal configuration, with six cutting elements used thereon, said six cutting elements being used in maximum diameter locations on said main body, so that said cutting elements can cut a well bore of a size corresponding to that created by said cutting discs, with such well bore diameter being assured, despite some wear of said cutting discs with use.

* * * * *